US011295572B2

(12) United States Patent
Russ et al.

(10) Patent No.: US 11,295,572 B2
(45) Date of Patent: Apr. 5, 2022

(54) PRESSURE AND TIME SENSITIVE INPUTS FOR GAMING DEVICES, AND RELATED DEVICES, SYSTEMS, AND METHODS

(71) Applicant: IGT, Las Vegas, NV (US)

(72) Inventors: Michael Russ, Graz (AT); Sven Aurich, Schwanberg (AT)

(73) Assignee: IGT, Las Vegas, NV (US)

( * ) Notice: Subject to any disclaimer, the term of this patent is extended or adjusted under 35 U.S.C. 154(b) by 61 days.

(21) Appl. No.: 16/569,257

(22) Filed: Sep. 12, 2019

(65) Prior Publication Data

US 2021/0082231 A1 Mar. 18, 2021

(51) Int. Cl.
*A63F 9/24* (2006.01)
*G07F 17/32* (2006.01)

(52) U.S. Cl.
CPC ..... *G07F 17/3209* (2013.01); *G07F 17/3211* (2013.01); *G07F 17/3262* (2013.01)

(58) Field of Classification Search
CPC .. G07F 17/32; G07F 17/3225; G07F 17/3209; G07F 17/3211; A63F 13/12; A63F 13/2145; A63F 13/57; A63F 2300/1056; A63F 13/218; A63F 13/426; A63F 13/428; A63F 13/53; A63F 2300/1075; A63F 13/10; A63F 13/42; A63F 2300/65; G06F 2203/04105; G06F 3/0488; G06F 3/0414
See application file for complete search history.

(56) References Cited

U.S. PATENT DOCUMENTS 6,567,102 B2 * 5/2003 Kung ..... G06F 3/0481 345/173
8,241,912 B2 8/2012 Loose
8,926,421 B2 1/2015 Arezina et al.
8,956,224 B2 2/2015 Gagner et al.
9,005,001 B2 4/2015 Jones et al.
9,235,267 B2 1/2016 Burrough et al.
(Continued)

FOREIGN PATENT DOCUMENTS

CN 103210429 10/2016

OTHER PUBLICATIONS

Jon Mundy, "7 iOS games made better by 3D Touch controls", Aug. 22, 2016, appspy.com, <https://www.appspy.com/feature/10861/7-ios-games-made-better-by-3d-touch-controls> (Year: 2016).*
(Continued)

*Primary Examiner* — Justin L Myhr
(74) *Attorney, Agent, or Firm* — Sage Patent Group

(57) ABSTRACT

Pressure and time sensitive inputs for gaming devices, and related devices, systems, and methods, are disclosed. An input device includes a pressure sensor to detect an amount of pressure applied to the input device by a player of the gaming device. A processor circuit receives, from the pressure sensor of the input device, a first pressure parameter value corresponding to a first amount of pressure being applied to the input device by the player at a first time. Based on the first pressure parameter value, a time value is determined corresponding to an amount of time that the player has continuously applied pressure to the input device in a first range of pressure amounts, wherein the first amount of pressure is within the first range of pressure amounts. Based on the first pressure parameter value and the time value, a user interface element of the gaming device is modified.

16 Claims, 11 Drawing Sheets

(56) References Cited

U.S. PATENT DOCUMENTS

| | | | | |
|---|---|---|---|---|
| 9,384,626 | B2 | 7/2016 | Walker et al. | |
| 10,180,723 | B2 | 1/2019 | Lisseman et al. | |
| 2001/0024971 | A1* | 9/2001 | Brassard | G07F 17/32 463/30 |
| 2003/0027619 | A1* | 2/2003 | Nicastro, Sr. | G07F 17/3267 463/16 |
| 2003/0032467 | A1* | 2/2003 | Mayer | A63F 13/812 463/4 |
| 2003/0064764 | A1* | 4/2003 | Kanno | A63F 13/10 463/2 |
| 2006/0211496 | A1* | 9/2006 | Manz | G07F 17/32 463/36 |
| 2008/0113772 | A1* | 5/2008 | Burrill | G07F 17/3239 463/25 |
| 2009/0143141 | A1 | 6/2009 | Wells et al. | |
| 2009/0174146 | A1* | 7/2009 | Wichinsky | G07F 17/3297 273/355 |
| 2011/0063248 | A1* | 3/2011 | Yoon | G06F 3/0485 345/174 |
| 2012/0193211 | A1* | 8/2012 | Ciesla | G06F 3/016 200/81 H |
| 2015/0294534 | A1* | 10/2015 | Augustine | G07F 17/3211 463/27 |
| 2016/0171827 | A1* | 6/2016 | Washington | A63F 13/822 463/22 |
| 2018/0089954 | A1* | 3/2018 | Carpenter | G07F 17/3276 |
| 2018/0373376 | A1* | 12/2018 | Kurabayashi | A63F 13/57 |
| 2019/0336852 | A1* | 11/2019 | Gao | G06F 3/03547 |

OTHER PUBLICATIONS

Lewis Leon, "Best 3D Touch Apps and Games for the iPhone 6s and iPhone 6s Plus", Dec. 21, 2015, IGN.com, <https://www.ign.com/articles/2015/12/21/best-3d-touch-apps-and-games-for-the-iphone-6s-and-iphone-6s-plus> (Year: 2015).*

* cited by examiner

400

400

PRESSURE AND TIME SENSITIVE INPUTS FOR GAMING DEVICES, AND RELATED DEVICES, SYSTEMS, AND METHODS

BACKGROUND

Embodiments described herein relate to providing input for gaming devices, and in particular to pressure and time sensitive inputs for gaming devices, and related devices, systems, and methods.

Gaming devices, such as electronic gaming machines (EGMs), may provide input devices for facilitating play of a game by a player at the gaming device, and for providing additional interactive functionality at the gaming device. Many conventional gaming devices employ relatively simple input devices, such as buttons or keypads, which limit the features and functionality that can be offered at the gaming device.

BRIEF SUMMARY

According to an embodiment, a gaming device includes an input device including a pressure sensor to detect an amount of pressure applied to the input device by a player of the gaming device. The gaming device further includes a processor circuit, and a memory coupled to the processor circuit. The memory includes machine-readable instructions that, when executed by the processor circuit, cause the processor circuit to receive, from the pressure sensor of the input device, a first pressure parameter value corresponding to a first amount of pressure being applied to the input device by the player at a first time. The instructions further cause the processor circuit to determine, based on the first pressure parameter value, a time value corresponding to an amount of time that the player has continuously applied pressure to the input device in a first range of pressure amounts, wherein the first amount of pressure is within the first range of pressure amounts. The instructions further cause the processor circuit to, based on the first pressure parameter value and the time value, modify a user interface element of the gaming device.

According to another embodiment, a method includes detecting, by a pressure sensor of an input device of a gaming device, a first amount of pressure being applied by a player to the input device at a first time. The method further includes generating, based on detecting the first amount of pressure at the first time, a first pressure parameter value. The method further includes receiving, by a processor circuit of the gaming device, the first pressure parameter value from the pressure sensor. The method further includes determining, based in part on the first pressure parameter value, a time value corresponding to an amount of time that the player has continuously applied pressure to the input device in a first range of pressure amounts, wherein the first range of pressure amounts comprises the first amount of pressure. The method further includes, based on the first pressure parameter value and the time value, modifying a user interface element of the gaming device.

According to another embodiment, a system includes a processor circuit, and a memory coupled to the processor circuit. The memory includes machine-readable instructions that, when executed by the processor circuit, cause the processor circuit to receive, from a pressure sensor of an input device of a gaming device, a first pressure parameter value corresponding to a first amount of pressure being applied to the input device by a player of the gaming device at a first time. The instructions further cause the processor circuit to determine, based on the first pressure parameter value, a time value corresponding to an amount of time that the player has continuously applied pressure to the input device in a first range of pressure amounts, wherein the first amount of pressure is within the first range of pressure amounts. The instructions further cause the processor circuit to, based on the first pressure parameter value and the time value, modify a user interface element of the gaming device.

DETAILED DESCRIPTION

According to embodiments described herein, pressure and time sensitive inputs for gaming devices, and related devices, systems, and methods, may provide unique technical solutions for the technical problem of providing accessible and intuitive input interface while providing complex functionality for gaming devices. In some embodiments, a gaming device includes an input device including a pressure sensor to detect an amount of pressure applied to the input device by a player of the gaming device. A processor circuit may receive, from the pressure sensor of the input device, a first pressure parameter value corresponding to a first amount of pressure being applied to the input device by the player at a first time. The processor circuit may next determine, based on the first pressure parameter value, a time value corresponding to an amount of time that the player has continuously applied pressure to the input device in a first range of pressure amounts, wherein the first amount of pressure is within the first range of pressure amounts. Based on the first pressure parameter value and the time value, the processor circuit may then modify a user interface element of the gaming device. These and other embodiments will be described in detail below.

Figure 1:
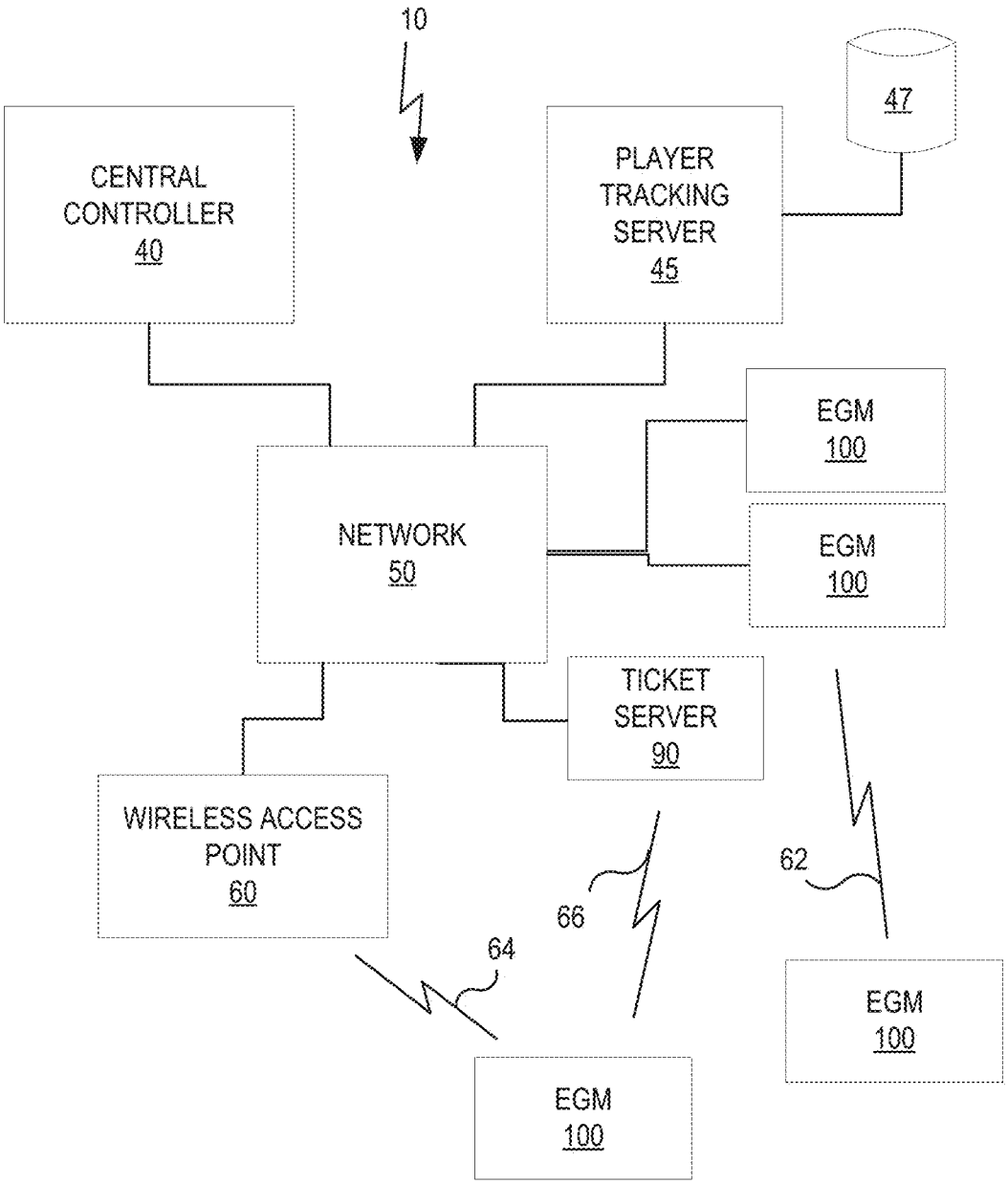
FIG. 1 is a schematic block diagram illustrating a network configuration for a plurality of gaming devices according to some embodiments.

Referring to FIG. 1, a gaming system 10 including a plurality of gaming devices 100 is illustrated. As discussed above, the gaming devices 100 may be one type of a variety of different types of gaming devices, such as electronic gaming machines (EGMs), mobile devices, or other devices, for example. The gaming system 10 may be located, for example, on the premises of a gaming establishment, such as a casino. The gaming devices 100, which are typically situated on a casino floor, may be in communication with each other and/or at least one central controller 40 through a data communication network 50 that may include a remote communication link. The data communication network 50 may be a private data communication network that is operated, for example, by the gaming facility that operates the gaming devices 100. Communications over the data communication network 50 may be encrypted for security. The central controller 40 may be any suitable server or computing device which includes at least one processing circuit and at least one memory or storage device. Each gaming device 100 may include a processing circuit that transmits and receives events, messages, commands or any other suitable data or signal between the gaming device 100 and the central controller 40. The gaming device processing circuit is operable to execute such communicated events, messages or commands in conjunction with the operation of the gaming device 100. Moreover, the processing circuit of the central controller 40 is configured to transmit and receive events, messages, commands or any other suitable data or signal between the central controller 40 and each of the individual gaming devices 100. In some embodiments, one or more of the functions of the central controller 40 may be performed by one or more gaming device processing circuits. Moreover, in some embodiments, one or more of the functions of one or more gaming device processing circuits as disclosed herein may be performed by the central controller 40.

A wireless access point 60 provides wireless access to the data communication network 50. The wireless access point 60 may be connected to the data communication network 50 as illustrated in FIG. 1, and/or may be connected directly to the central controller 40 or another server connected to the data communication network 50.

A player tracking server 45 may also be connected through the data communication network 50. The player tracking server 45 may manage a player tracking account that tracks the player's gameplay and spending and/or other player preferences and customizations, manages loyalty awards for the player, manages funds deposited or advanced on behalf of the player, and other functions. Player information managed by the player tracking server 45 may be stored in a player information database 47.

As further illustrated in FIG. 1, the gaming system 10 may include a ticket server 90 that is configured to print and/or dispense wagering tickets. The ticket server 90 may be in communication with the central controller 40 through the data communication network 50. Each ticket server 90 may include a processing circuit that transmits and receives events, messages, commands or any other suitable data or signal between the ticket server 90 and the central controller 40. The ticket server 90 processing circuit may be operable to execute such communicated events, messages or commands in conjunction with the operation of the ticket server 90. Moreover, in some embodiments, one or more of the functions of one or more ticket server 90 processing circuits as disclosed herein may be performed by the central controller 40.

The gaming devices 100 communicate with one or more elements of the system 10 to coordinate providing wagering games and other functionality. For example, in some embodiments, the gaming device 100 may communicate directly with the ticket server 90 over a wireless interface 62, which may be a WiFi link, a Bluetooth link, an NFC link, etc. In other embodiments, the gaming device 100 may communicate with the data communication network 50 (and devices connected thereto, including other gaming devices 100) over a wireless interface 64 with the wireless access point 60. The wireless interface 64 may include a WiFi link, a Bluetooth link, an NFC link, etc. In still further embodiments, the gaming devices 100 may communicate simultaneously with both the ticket server 90 over the wireless interface 66 and the wireless access point 60 over the wireless interface 64. Some embodiments provide that gaming devices 100 may communicate with other gaming devices over a wireless interface 64. In these embodiments, wireless interface 62, wireless interface 64 and wireless interface 66 may use different communication protocols and/or different communication resources, such as different frequencies, time slots, spreading codes, etc.

Gaming Devices

Figure 2A:
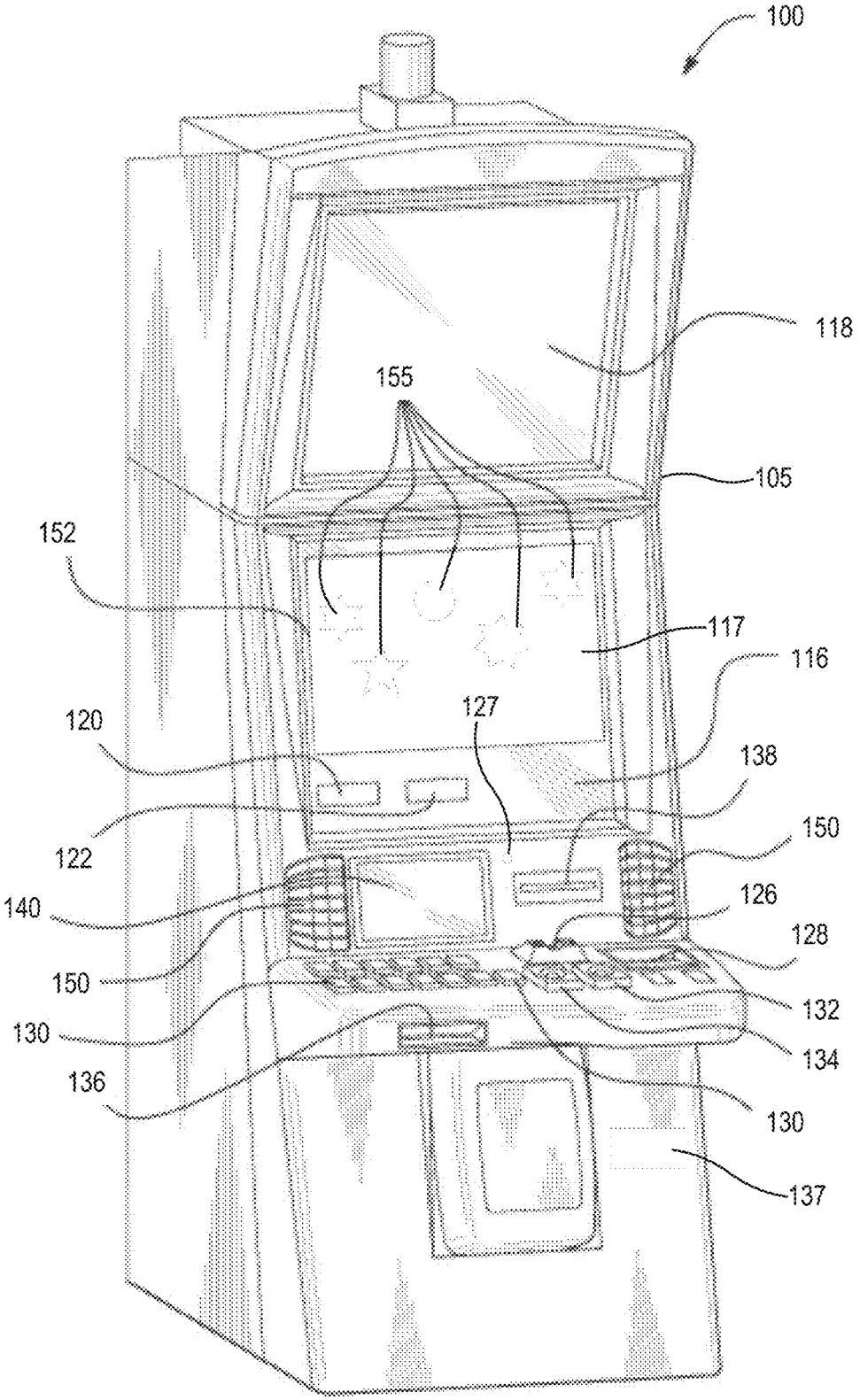
FIG. 2A is a perspective view of a gaming device that can be configured according to some embodiments.
Figure 2B:
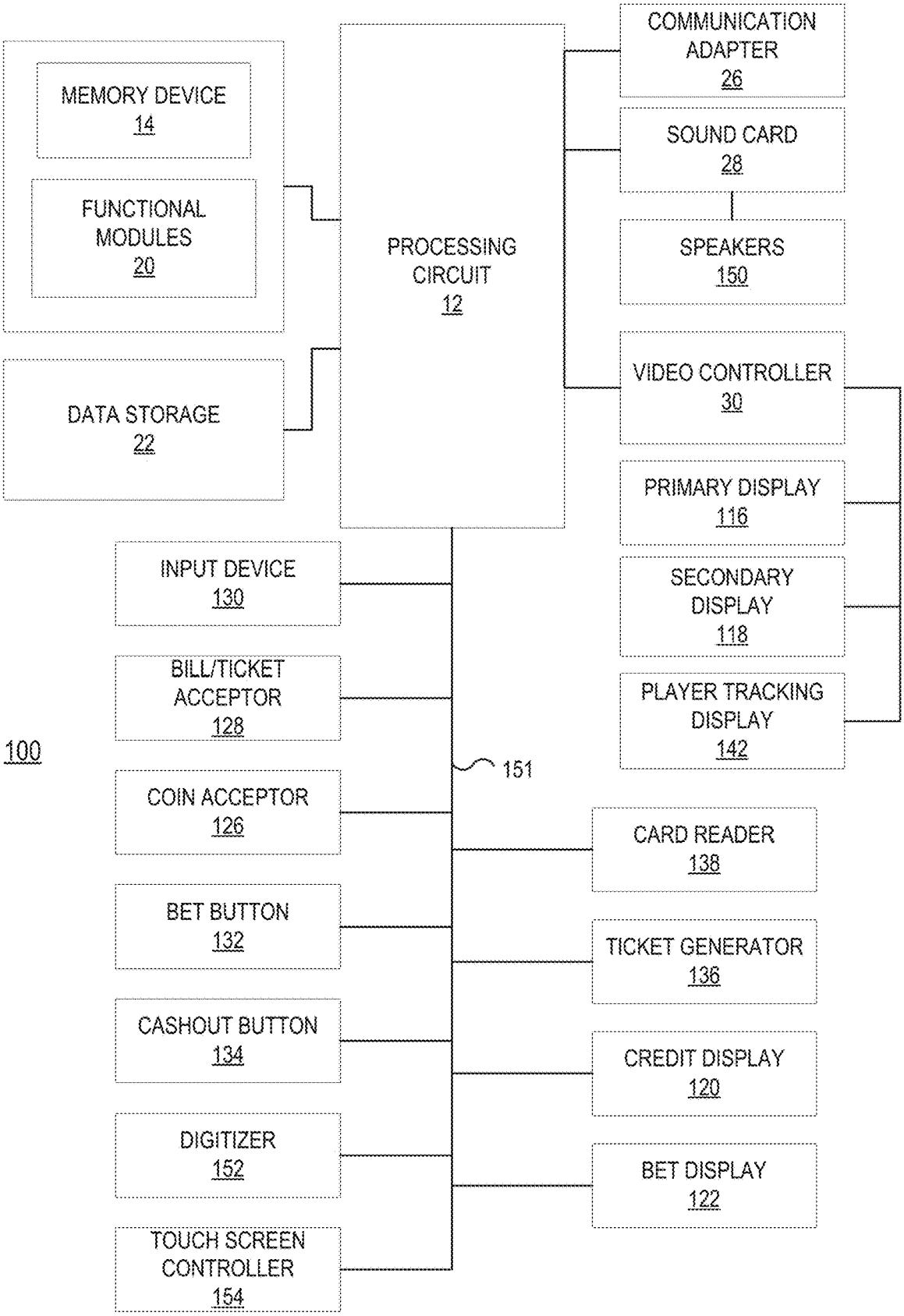
FIG. 2B is a schematic block diagram illustrating an electronic configuration for a gaming device according to some embodiments.
Figure 2C:
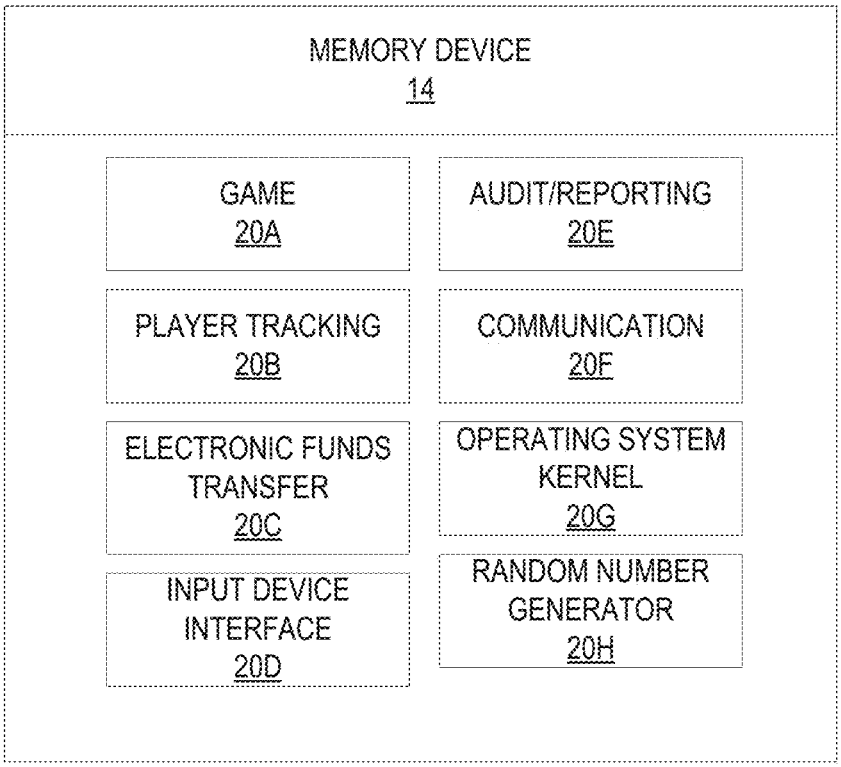
FIG. 2C is a schematic block diagram that illustrates various functional modules of a gaming device according to some embodiments.

Embodiments herein may include different types of gaming devices. One example of a gaming device includes a gaming device 100 that can use pressure and time sensitive inputs according to various embodiments is illustrated in FIGS. 2A, 2B, and 2C in which FIG. 2A is a perspective view of a gaming device 100 illustrating various physical features of the device, FIG. 2B is a functional block diagram that schematically illustrates an electronic relationship of various elements of the gaming device 100, and FIG. 2C illustrates various functional modules that can be stored in a memory device of the gaming device 100. The embodiments shown in FIGS. 2A to 2C are provided as examples for illustrative purposes only. It will be appreciated that gaming devices may come in many different shapes, sizes, layouts, form factors, and configurations, and with varying numbers and types of input and output devices, and that embodiments of the inventive concepts are not limited to the particular gaming device structures described herein.

Gaming devices 100 typically include a number of standard features, many of which are illustrated in FIGS. 2A and 2B. For example, referring to FIG. 2A, a gaming device 100 may include a support structure, housing 105 (e.g., cabinet) which provides support for a plurality of displays, inputs, outputs, controls and other features that enable a player to interact with the gaming device 100.

The gaming device 100 illustrated in FIG. 2A includes a number of display devices, including a primary display device 116 located in a central portion of the housing 105 and a secondary display device 118 located in an upper portion of the housing 105. A plurality of game components 155 are displayed on a display screen 117 of the primary display device 116. It will be appreciated that one or more of the display devices 116, 118 may be omitted, or that the display devices 116, 118 may be combined into a single display device. The gaming device 100 may further include a player tracking display 142, a credit display 120, and a bet display 122. The credit display 120 displays a player's current number of credits, cash, account balance or the equivalent. The bet display 122 displays a player's amount wagered. Locations of these displays are merely illustrative as any of these displays may be located anywhere on the gaming device 100.

The player tracking display 142 may be used to display a service window that allows the player to interact with, for example, their player loyalty account to obtain features, bonuses, comps, etc. In other embodiments, additional display screens may be provided beyond those illustrated in FIG. 2A. In some embodiments, one or more of the player tracking display 142, the credit display 120 and the bet display 122 may be displayed in one or more portions of one or more other displays that display other game related visual content. For example, one or more of the player tracking display 142, the credit display 120 and the bet display 122 may be displayed in a picture in a picture on one or more displays.

The gaming device 100 may further include a number of pressure sensitive input devices 130 that allow a player to provide various inputs to the gaming device 100, either before, during or after a game has been played. The gaming device may further include a game play initiation button 132 and a cashout button 134. The cashout button 134 is utilized to receive a cash payment or any other suitable form of payment corresponding to a quantity of remaining credits of a credit display.

In some embodiments, one or more input devices of the gaming device 100 are one or more game play activation devices that are each used to initiate a play of a game on the gaming device 100 or a sequence of events associated with the gaming device 100 following appropriate funding of the gaming device 100. The example gaming device 100 illustrated in FIGS. 2A and 2B includes a game play activation device in the form of a game play initiation button 132. It should be appreciated that, in other embodiments, the gaming device 100 begins game play automatically upon appropriate funding rather than upon utilization of the game play activation device.

In some embodiments, one or more pressure sensitive input device 130 of the gaming device 100 may include wagering or betting functionality. For example, a maximum wagering or betting function may be provided that, when utilized, causes a maximum wager to be placed. Another such wagering or betting function is a repeat the bet device that, when utilized, causes the previously-placed wager to be placed. A further such wagering or betting function is a bet one function. A bet is placed upon utilization of the bet one function. The bet is increased by one credit each time the bet one device is utilized. Upon the utilization of the bet one function, a quantity of credits shown in a credit display (as described below) decreases by one, and a number of credits shown in a bet display (as described below) increases by one.

In some embodiments, one or more of the display screens may a touch-sensitive display that includes a digitizer 152 and a touchscreen controller 154 (FIG. 2B). The player may interact with the gaming device 100 by touching virtual buttons on one or more of the display devices 116, 118, 140. Accordingly, any of the above described input devices, such as the pressure sensitive input device 130, the game play initiation button 132 and/or the cashout button 134 may be provided as virtual buttons or regions on one or more of the display devices 116, 118, 140.

Referring briefly to FIG. 2B, operation of the primary display device 116, the secondary display device 118 and the player tracking display 142 may be controlled by a video controller 30 that receives video data from a processing circuit 12 or directly from a memory device 14 and displays the video data on the display screen. The credit display 120 and the bet display 122 are typically implemented as simple LCD or LED displays that display a number of credits available for wagering and a number of credits being wagered on a particular game. Accordingly, the credit display 120 and the bet display 122 may be driven directly by the processing circuit 12. In some embodiments however, the credit display 120 and/or the bet display 122 may be driven by the video controller 30.

Referring again to FIG. 2A, the display devices 116, 118, 140 may include, without limitation: a cathode ray tube, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display devices 116, 118, 140 may include a touchscreen with an associated touchscreen controller 154 and digitizer 152. The display devices 116, 118, 140 may be of any suitable size, shape, and/or configuration. The display devices 116, 118, 140 may include flat or curved display surfaces.

The display devices 116, 118, 140 and video controller 30 of the gaming device 100 are generally configured to display one or more game and/or non-game images, symbols, and indicia. In certain embodiments, the display devices 116, 118, 140 of the gaming device 100 are configured to display any suitable visual representation or exhibition of the movement of objects; dynamic lighting; video images; images of people, characters, places, things, and faces of cards; and the like. In certain embodiments, the display devices 116, 118, 140 of the gaming device 100 are configured to display one or more virtual reels, one or more virtual wheels, and/or one or more virtual dice. In other embodiments, certain of the displayed images, symbols, and indicia are in mechanical form. That is, in these embodiments, the display device 116, 118, 140 includes any electromechanical device, such as one or more rotatable wheels, one or more reels, and/or one or more dice, configured to display at least one or a plurality of game or other suitable images, symbols, or indicia.

The gaming device 100 also includes various features that enable a player to deposit credits in the gaming device 100 and withdraw credits from the gaming device 100, such as in the form of a payout of winnings, credits, etc. For example, the gaming device 100 may include a ticket dispenser 136, a bill/ticket acceptor 128, and a coin acceptor 126 that allows the player to deposit coins into the gaming device 100.

As illustrated in FIG. 2A, the gaming device 100 may also include a currency dispenser 137 that may include a note dispenser configured to dispense paper currency and/or a coin generator configured to dispense coins or tokens in a coin payout tray.

The gaming device 100 may further include one or more speakers 150 controlled by one or more sound cards 28 (FIG. 2B). The gaming device 100 illustrated in FIG. 2A includes a pair of speakers 150. In other embodiments, additional speakers, such as surround sound speakers, may be provided within or on the housing 105. Moreover, the gaming device 100 may include built-in seating with integrated headrest speakers.

In various embodiments, the gaming device 100 may generate dynamic sounds coupled with attractive multimedia images displayed on one or more of the display devices 116, 118, 140 to provide an audio-visual representation or to otherwise display full-motion video with sound to attract players to the gaming device 100 and/or to engage the player during gameplay. In certain embodiments, the gaming device 100 may display a sequence of audio and/or visual attraction messages during idle periods to attract potential players to the gaming device 100. The videos may be customized to provide any appropriate information.

The gaming device 100 may further include a card reader 138 that is configured to read magnetic stripe cards, such as player loyalty/tracking cards, chip cards, and the like. In some embodiments, a player may insert an identification card into a card reader of the gaming device. In some embodiments, the identification card is a smart card having a programmed microchip or a magnetic strip coded with a player's identification, credit totals (or related data) and other relevant information. In other embodiments, a player may carry a portable device, such as a cell phone, a radio frequency identification tag or any other suitable wireless device, which communicates a player's identification, credit totals (or related data) and other relevant information to the gaming device. In some embodiments, money may be transferred to a gaming device through electronic funds transfer. When a player funds the gaming device, the processing circuit determines the amount of funds entered and displays the corresponding amount on the credit or other suitable display as described above.

In some embodiments, the gaming device 100 may include an electronic payout device or module configured to fund an electronically recordable identification card or smart card or a bank or other account via an electronic funds transfer to or from the gaming device 100.

FIG. 2B is a block diagram that illustrates logical and functional relationships between various components of a gaming device 100. It should also be understood that components described in FIG. 2B may also be used in other computing devices, as desired, such as mobile computing devices for example. As shown in FIG. 2B, the gaming device 100 may include a processing circuit 12 that controls operations of the gaming device 100. Although illustrated as a single processing circuit, multiple special purpose and/or general purpose processors and/or processor cores may be provided in the gaming device 100. For example, the gaming device 100 may include one or more of a video processor, a signal processor, a sound processor and/or a communication controller that performs one or more control functions within the gaming device 100. The processing circuit 12 may be variously referred to as a "controller," "microcontroller," "microprocessor" or simply a "computer." The processor may further include one or more application-specific integrated circuits (ASICs).

Various components of the gaming device 100 are illustrated in FIG. 2B as being connected to the processing circuit 12. It will be appreciated that the components may be connected to the processing circuit 12 through a system bus, a communication bus and controller, such as a USB controller and USB bus, a network interface, or any other suitable type of connection.

The gaming device 100 further includes a memory device 14 that stores one or more functional modules 20. Various functional modules 20 of the gaming device 100 will be described in more detail below in connection with FIG. 2D.

The memory device 14 may store program code and instructions, executable by the processing circuit 12, to control the gaming device 100. The memory device 14 may also store other data such as image data, event data, player input data, random or pseudorandom number generators, pay-table data or information and applicable game rules that relate to the play of the gaming device. The memory device 14 may include random access memory (RAM), which can include non-volatile RAM (NVRAM), magnetic RAM (ARAM), ferroelectric RAM (FeRAM) and other forms as commonly understood in the gaming industry. In some embodiments, the memory device 14 may include read only memory (ROM). In some embodiments, the memory device 14 may include flash memory and/or EEPROM (electrically erasable programmable read only memory). Any other suitable magnetic, optical and/or semiconductor memory may operate in conjunction with the gaming device disclosed herein.

The gaming device 100 may further include a data storage 22, such as a hard disk drive or flash memory. The data storage 22 may store program data, player data, audit trail data or any other type of data. The data storage 22 may include a detachable or removable memory device, including, but not limited to, a suitable cartridge, disk, CD ROM, DVD or USB memory device.

The gaming device 100 may include a communication adapter 26 that enables the gaming device 100 to communicate with remote devices over a wired and/or wireless communication network, such as a local area network (LAN), wide area network (WAN), cellular communication network, or other data communication network. The communication adapter 26 may further include circuitry for supporting short range wireless communication protocols, such as Bluetooth and/or near field communications (NFC) that enable the gaming device 100 to communicate, for example, with a mobile communication device operated by a player.

The gaming device 100 may include one or more internal or external communication ports that enable the processing circuit 12 to communicate with and to operate with internal or external peripheral devices, such as eye tracking devices, position tracking devices, cameras, accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumb drives, ticket readers, touch screens, trackballs, touchpads, wheels, and wireless communication devices. In some embodiments, internal or external peripheral devices may communicate with the processing circuit through a universal serial bus (USB) hub (not shown) connected to the processing circuit 12.

In some embodiments, the gaming device 100 may include a sensor, such as a camera in communication with the processing circuit 12 (and possibly controlled by the processing circuit 12) that is selectively positioned to acquire an image of a player actively using the gaming device 100 and/or the surrounding area of the gaming device 100. In one embodiment, the camera may be configured to selectively acquire still or moving (e.g., video) images and may be configured to acquire the images in either an analog, digital or other suitable format. The display devices 116, 118, 140 may be configured to display the image acquired by the camera as well as display the visible manifestation of the game in split screen or picture-in-picture fashion. For example, the camera may acquire an image of the player and the processing circuit 12 may incorporate that image into the primary and/or secondary game as a game image, symbol or indicia.

Various functional modules of that may be stored in a memory device 14 of a gaming device 100 are illustrated in FIG. 2C. Referring to FIG. 2C, the gaming device 100 may include in the memory device 14 a game module 20A that includes program instructions and/or data for operating a hybrid wagering game as described herein. The gaming device 100 may further include a player tracking module 20B, an electronic funds transfer module 20C, an input device interface 20D, an audit/reporting module 20E, a communication module 20F, an operating system kernel 20G and a random number generator 20H. The player tracking module 20B keeps track of the play of a player. The electronic funds transfer module 20C communicates with a back end server or financial institution to transfer funds to and from an account associated with the player. The input device interface 20D interacts with input devices, such as the pressure sensitive input device 130, as described in more detail below. The communication module 20F enables the gaming device 100 to communicate with remote servers and other gaming devices using various secure communication interfaces. The operating system kernel 20G controls the overall operation of the gaming device 100, including the loading and operation of other modules. The random number generator 20H generates random or pseudorandom numbers for use in the operation of the hybrid games described herein.

In some embodiments, a gaming device 100 comprises a personal device, such as a desktop computer, a laptop computer, a mobile device, a tablet computer or computing device, a personal digital assistant (PDA), or other portable computing devices. In some embodiments, the gaming device 100 may be operable over a wireless network, such as part of a wireless gaming system. In such embodiments, the gaming machine may be a hand-held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission.

Figure 2D:
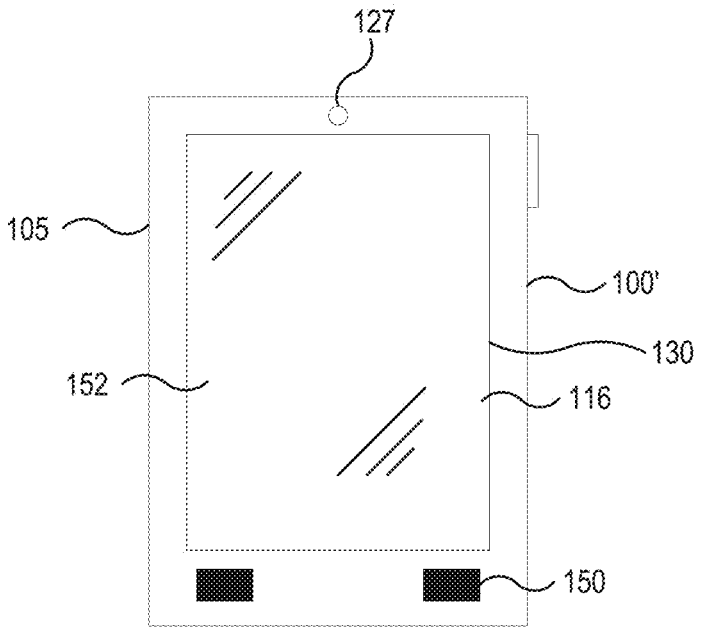
FIG. 2D is perspective view of a gaming device that can be configured according to some embodiments.

For example, referring to FIG. 2D, a gaming device 100' may be implemented as a handheld device including a compact housing 105 on which is mounted a touchscreen display device 116 including a digitizer 152. As described in greater detail with respect to FIG. 3 below, one or more pressure sensitive input devices 130 may be included for providing functionality of for embodiments described herein. A camera 127 may be provided in a front face of the housing 105. The housing 105 may include one or more speakers 150. In the gaming device 100', various input buttons described above, such as the cashout button, gameplay activation button, etc., may be implemented as soft buttons on the touchscreen display device 116 and/or pressure sensitive input device 130. In this embodiment, the pressure sensitive input device 130 is integrated into the touchscreen display device 116, but it should be understood that the pressure sensitive input device may also, or alternatively, be separate from the display device 116. Moreover, the gaming device 100' may omit certain features, such as a bill acceptor, a ticket generator, a coin acceptor or dispenser, a card reader, secondary displays, a bet display, a credit display, etc. Credits can be deposited in or transferred from the gaming device 100' electronically.

Figure 2E:
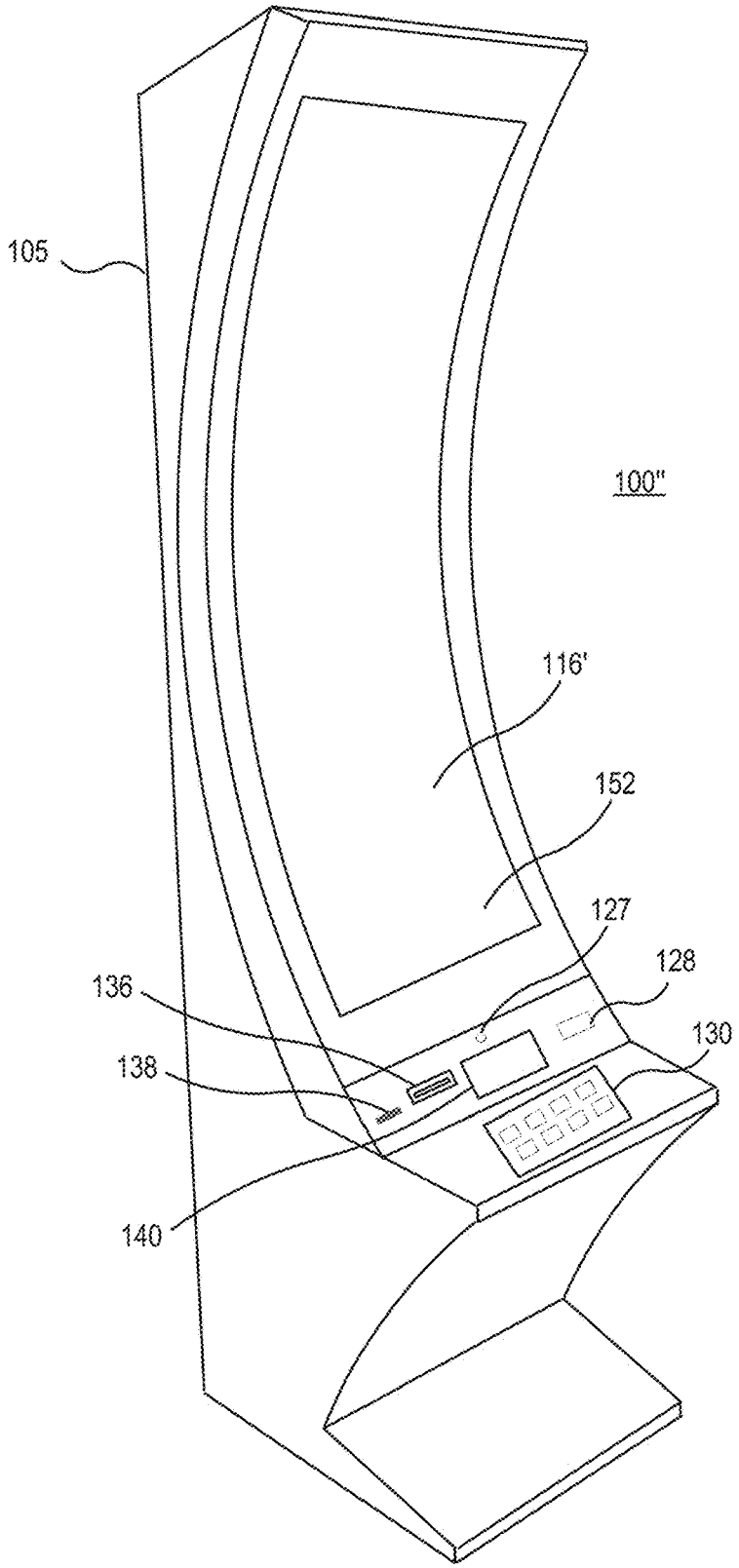
FIG. 2E is a perspective view of a gaming device according to further embodiments.

FIG. 2E illustrates a standalone gaming device 100" having a different form factor from the gaming device 100 illustrated in FIG. 2A. In particular, the gaming device 100" is characterized by having a large, high aspect ratio, curved primary display device 116' provided in the housing 105, with no secondary display device. The primary display device 116' may include a digitizer 152 to allow touchscreen interaction with the primary display device 116'. The gaming device 100" may further include a player tracking display 142, a pressure sensitive input device 130, a bill/ticket acceptor 128, a card reader 138, and a bill/ticket dispenser 136. The gaming device 100" may further include one or more cameras 127 to enable facial recognition and/or motion tracking.

Although illustrated as certain gaming devices, such as electronic gaming machines (EGMs) and mobile devices, similar functions and/or operations as described herein may include wagering stations that may include electronic game tables, conventional game tables including those involving cards, dice and/or roulette, and/or other wagering stations such as sports book stations, video poker games, skill-based games, virtual casino-style table games, or other casino or non-casino style games. Further, gaming devices according to embodiments herein may be implemented using other computing devices and mobile devices, such as smart phones, tablets, and/or personal computers, among others.

Input Device Features

Figure 3:
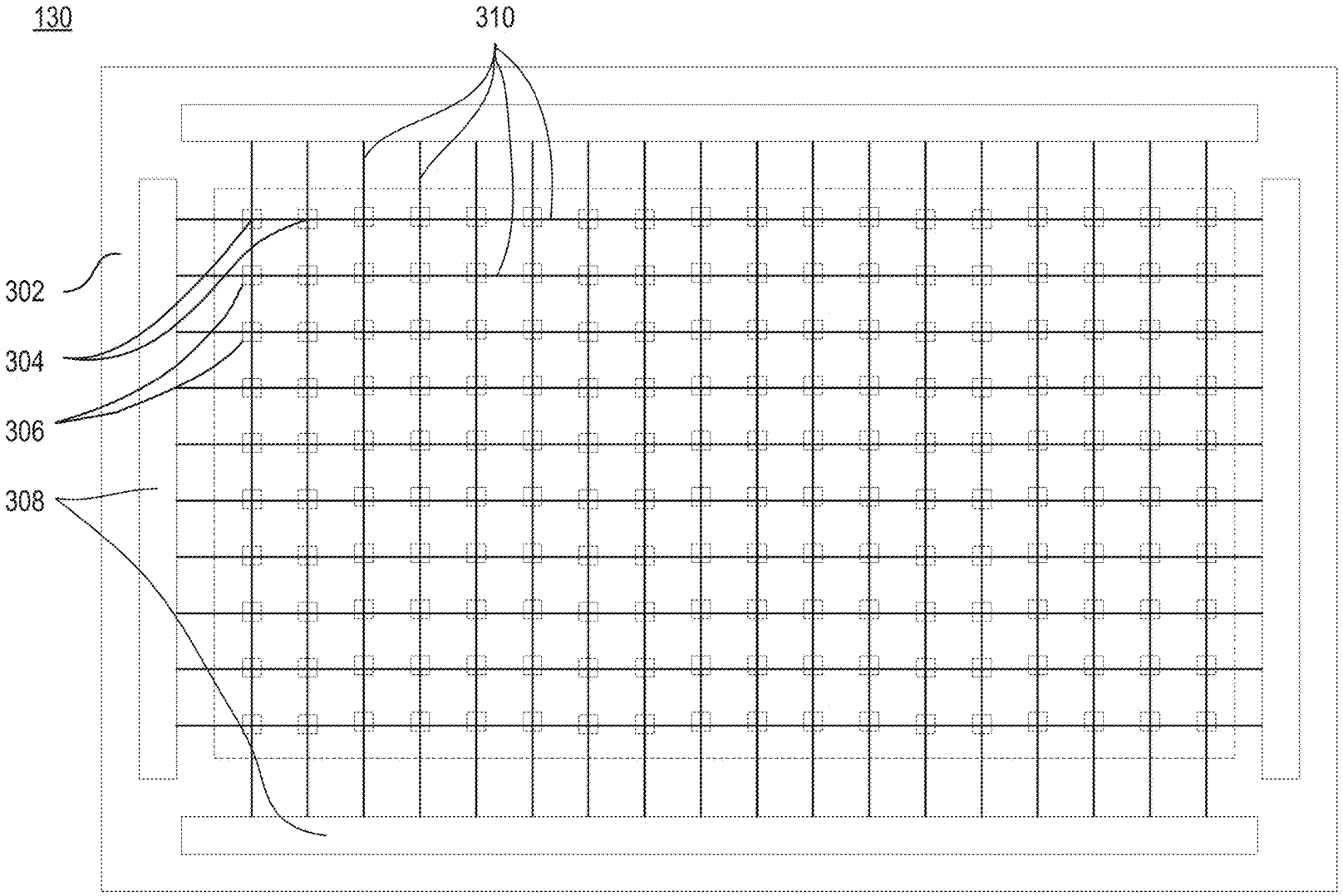
FIG. 3 is a schematic diagram that illustrates various components of an input device according to some embodiments.

Referring now to FIG. 3, a schematic diagram of components of a pressure sensitive input device 130 is are illustrated, according to some embodiments. The pressure sensitive input device 130 includes a printed circuit board 302 having a two-dimensional array of sensor locations 304. A pressure sensitive sensor 306 is located at each sensor location 304 to detect an amount of pressure being applied to the particular sensor location 304, e.g., by a player applying pressure to the sensor location 304 as part of game play. The pressure sensitive sensor 306 may function in a variety of ways. In this example, the pressure sensitive sensors 306 are coupled to one or more controller circuits 308 via one or more conductive lines 310.

In some embodiments, the conductive lines 310 and controller circuit 308 may also, or alternatively, provide capacitive and/or resistive touch screen and/or touch pad functionality. For example, the controller circuits 308 may determine a sensor location 304 through an increase in capacitance of particular conductive lines 310 that intersect at the particular sensor location 304, caused by the player applying pressure to the particular sensor location 304. In another example, the player applying pressure to the particular sensor location 304 may cause the conductive lines that intersect at the particular sensor location 304 to contact each other and conduct a current between the controller circuits 308. In some examples, one or more individual pressure sensitive sensors 306 may associated with each respective sensor location 304, with each individual pressure sensitive sensor 306 independently detecting pressure being applied at the particular sensor location 304. Additional functionality may also include providing feedback, such as audio, visual, and/or haptic feedback, based on an amount of detected pressure at a particular sensor location 304.

It should be understood that a wide variety of pressure sensitive sensors and/or input devices may be used to provide features and functionality described herein. For example, one suitable pressure sensitive input device for many embodiments described herein is the Sensel Morph touch interface, which includes an active area having an array of approximately 20,000 pressure sensors at a density of approximately 6500 sensors per inch. Each sensor is capable of sensing 32,000 levels of pressure in a range between 5 g and 5 kg. The interface can operate at different speeds and latencies, such as a full resolution mode at 125 Hz, which provides greater precision but higher latency (e.g., 8 ms), or a higher speed, lower resolution mode at 500 Hz, which provides lower latency (e.g., 2 ms) but with lower precision.

Other Gaming Device Features

Embodiments described herein may be implemented in various configurations for gaming devices 100*s*, including but not limited to: (1) a dedicated gaming device, wherein the computerized instructions for controlling any games (which are provided by the gaming device) are provided with the gaming device prior to delivery to a gaming establishment; and (2) a changeable gaming device, where the computerized instructions for controlling any games (which are provided by the gaming device) are downloadable to the gaming device through a data network when the gaming device is in a gaming establishment. In some embodiments, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In some embodiments, a gaming device may be operated by a mobile device, such as a mobile telephone, tablet other mobile computing device. For example, a mobile device may be communicatively coupled to a gaming device and may include a user interface that receives user inputs that are received to control the gaming device. The user inputs may be received by the gaming device via the mobile device.

In some embodiments, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more gaming devices; and/or (c) one or more personal gaming devices, such as desktop computers, laptop computers, tablet computers or computing devices, personal digital assistants (PDAs), mobile telephones such as smart phones, and other mobile computing devices.

In certain such embodiments, computerized instructions for controlling any games (such as any primary or base games and/or any secondary or bonus games) displayed by the gaming device are executed by the central server, central controller, or remote host. In such "thin client" embodiments, the central server, central controller, or remote host remotely controls any games (or other suitable interfaces) displayed by the gaming device, and the gaming device is utilized to display such games (or suitable interfaces) and to receive one or more inputs or commands. In other such embodiments, computerized instructions for controlling any games displayed by the gaming device are communicated from the central server, central controller, or remote host to the gaming device and are stored in at least one memory device of the gaming device. In such "thick client" embodiments, the at least one processor of the gaming device executes the computerized instructions to control any games (or other suitable interfaces) displayed by the gaming device.

In some embodiments in which the gaming system includes: (a) a gaming device configured to communicate with a central server, central controller, or remote host through a data network; and/or (b) a plurality of gaming devices configured to communicate with one another through a data network, the data network is an internet or an intranet. In certain such embodiments, an internet browser of the gaming device is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the gaming device, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the gaming device.

It should be appreciated that the central server, central controller, or remote host and the gaming device are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of gaming devices to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

Pressure Sensitive Input Features

By providing pressure sensitive input features, human machine interactions between players and gaming devices may be enhanced by offering players additional control and functionalities. Such functionality may include pushing the input device at a particular sensor location to exceed a defined pressure threshold and generate a response, such as a haptic response for example. This functionality may simulate pressing physical buttons or interaction with other mechanical devices in some examples.

Figure 4A:
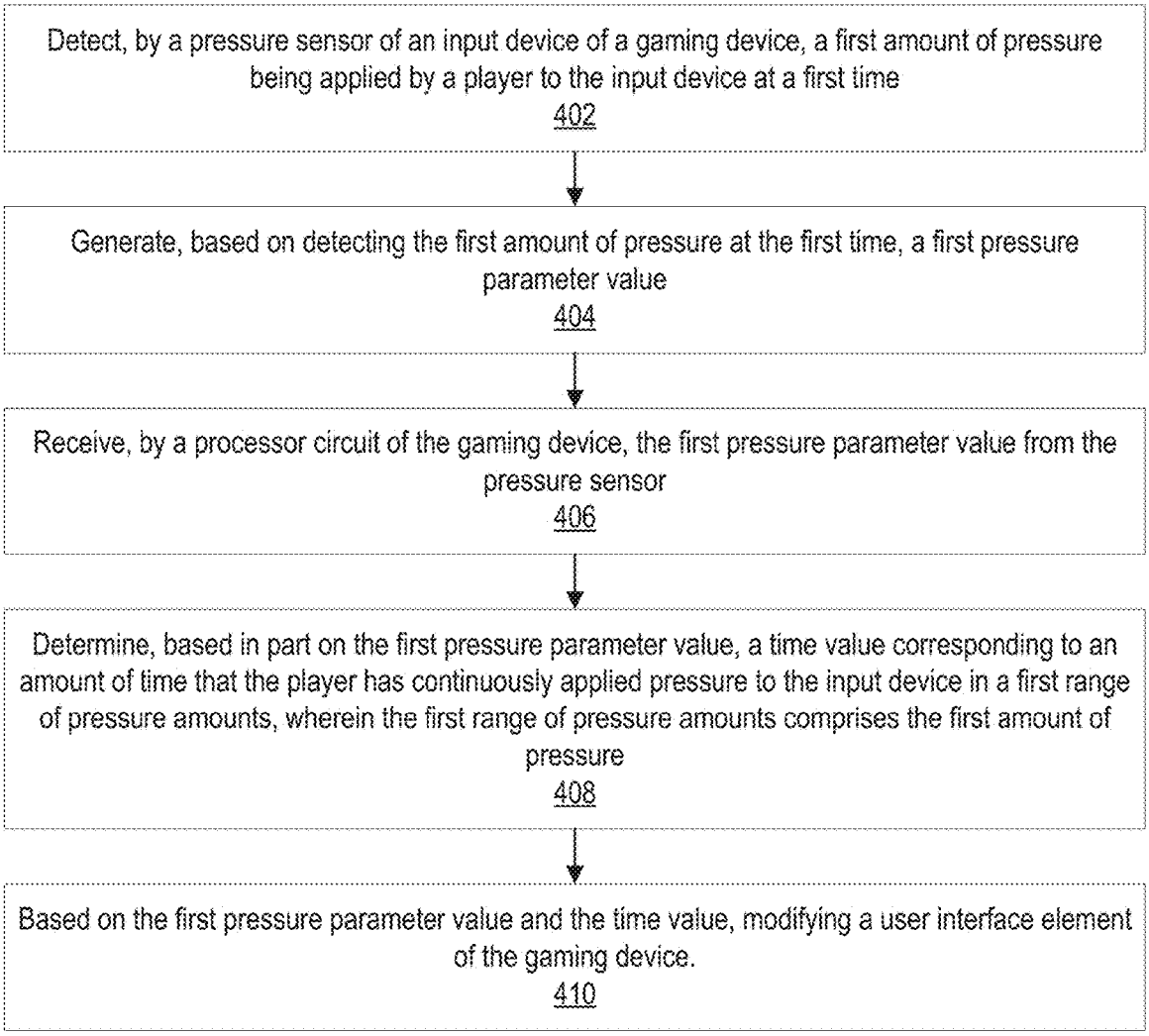
FIGS. 4A and 4B are flowcharts illustrating operations of systems/methods according to some embodiments.
Figure 4B:
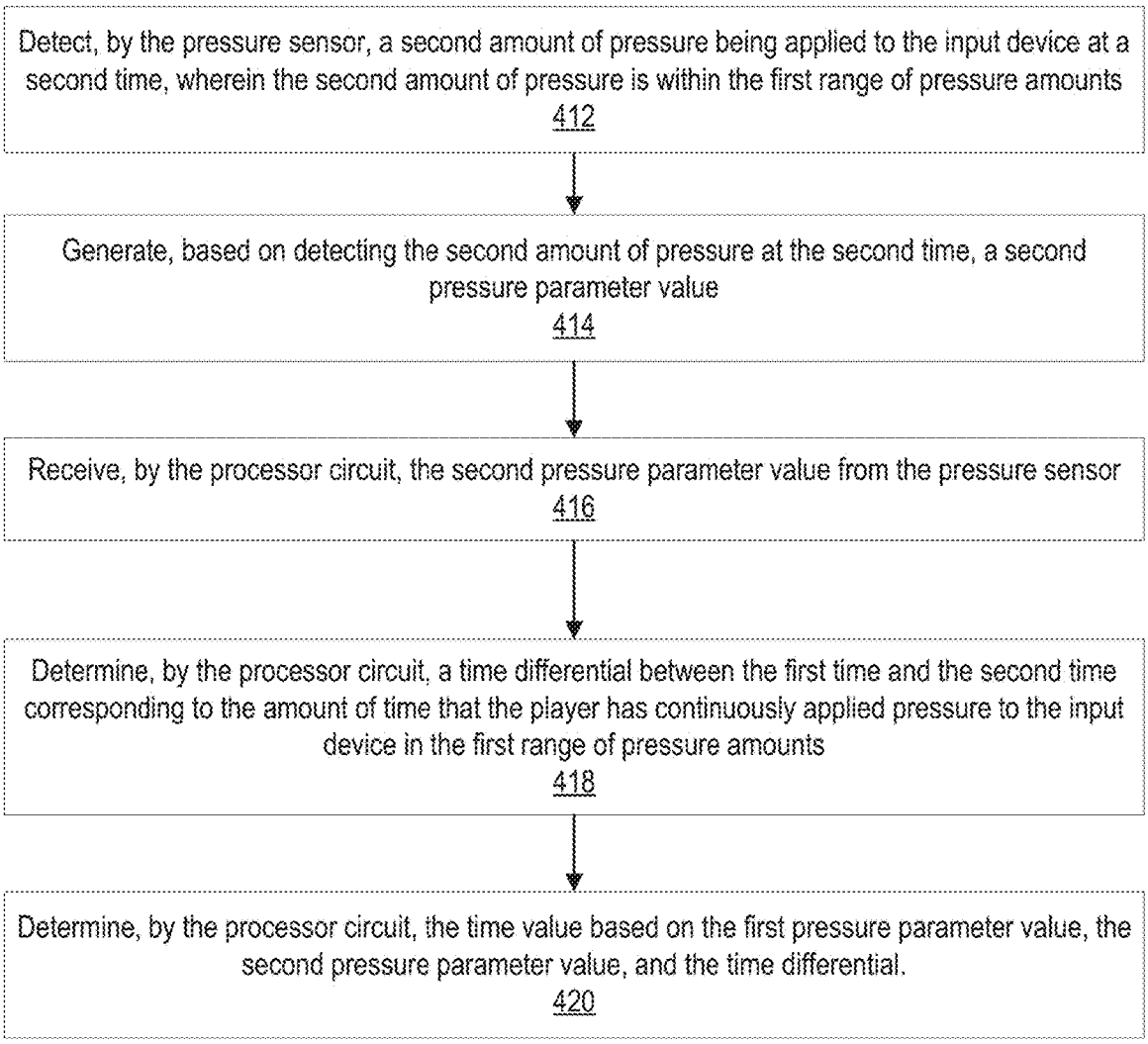

In some examples, a detected amount of pressure at a particular sensor location may be combined with a length of time the pressure is applied to provide more specific, unique functionalities at the gaming device. In this regard, FIGS. 4A and 4B are flowcharts illustrating operations 400 of systems/methods according to some embodiments. Referring now to FIG. 4A, the operations 400 may include detecting, by a pressure sensor of an input device of a gaming device, a first amount of pressure being applied by a player to the input device at a first time (Block 402). The operations 400 may further include generating, based on detecting the first amount of pressure at the first time, a first pressure parameter value (Block 404). The operations 400 may further include receiving, by a processor circuit of the gaming device, the first pressure parameter value from the pressure sensor (Block 406). The operations 400 may further include determining, based in part on the first pressure parameter value, a time value corresponding to an amount of time that the player has continuously applied pressure to the input device in a first range of pressure amounts, wherein the first range of pressure amounts comprises the first amount of pressure (Block 408). The operations 400 may further include, based on the first pressure parameter value and the time value, modifying a user interface element of the gaming device (Block 410).

Referring now to FIG. 4B, the operations 400 may further include detecting, by the pressure sensor, a second amount of pressure being applied to the input device at a second time, wherein the second amount of pressure is within the first range of pressure amounts (Block 412), and generating, based on detecting the second amount of pressure at the second time, a second pressure parameter value (Block 414). The operations 400 may further include receiving, by the processor circuit, the second pressure parameter value from the pressure sensor (Block 416), and determining, by the processor circuit, a time differential between the first time and the second time corresponding to the amount of time that the player has continuously applied pressure to the input device in the first range of pressure amounts (Block 418). The operations 400 may further include determining, by the processor circuit, the time value based on the first pressure parameter value, the second pressure parameter value, and the time differential (Block 420). In this example, the operations of blocks 412-420 of FIG. 4B may occur prior to and/or as part of the operation of block 408 of FIG. 4A, but it should be understood that these and other operations may occur in different orders, and may be duplicated and/or omitted as desired.

Operations may also include detecting, by the pressure sensor at a plurality of intermediate times between the first time and the second time, a plurality of intermediate amounts of pressure, and generating a plurality of intermediate pressure parameter values therefrom, which are received by the processor circuit receiving. Determining the time value may be further based on determining, by the processor circuit, that each intermediate amount of pressure is within the first range of pressure amounts.

It should also be understood that devices and systems described herein may perform some or all of the disclosed operations 400. For example, a gaming device 100 and components thereof, described above with respect to FIGS. 1-3, may have an input device, a processor circuit, and a memory to perform these and similar operations.

The user interface element(s) may be modified in many different ways, in response to different pressure and time combinations. For example, in response to the first pressure parameter value satisfying a predetermined pressure threshold, the user interface element may be modified to display a modified user interface element at a display device of the gaming device. Similarly, in response to the first pressure parameter value failing to satisfy the predetermined pressure threshold, the user interface element to may be modified to display another modified user interface element at the display device of the gaming device.

Alternatively, or in addition, the user interface element may be modified in response to the time value satisfying a predetermined time threshold, to display a modified user interface element at a display device of the gaming device, and/or, in response to the time value failing to satisfy the predetermined time threshold, to display different modified user interface elements at the display device. For example, in response to the first pressure parameter value satisfying a predetermined pressure threshold and the time value satisfying a predetermined time threshold, an audio device volume may be modified (i.e., increased or decreases) at a first predetermined rate, and in response to the first pressure parameter value failing to satisfy the predetermined pressure threshold and the time value satisfying the predetermined time threshold, the audio device volume may be modified at a second, lower, predetermined rate. In response to the first pressure parameter value satisfying the predetermined pressure threshold, the audio device volume may be modified by a particular volume amount if the time value fails to satisfy the predetermined time threshold, and may be modified by a lower volume amount lower than the first predetermined volume amount if the time value satisfies the predetermined time threshold.

Figure 5:
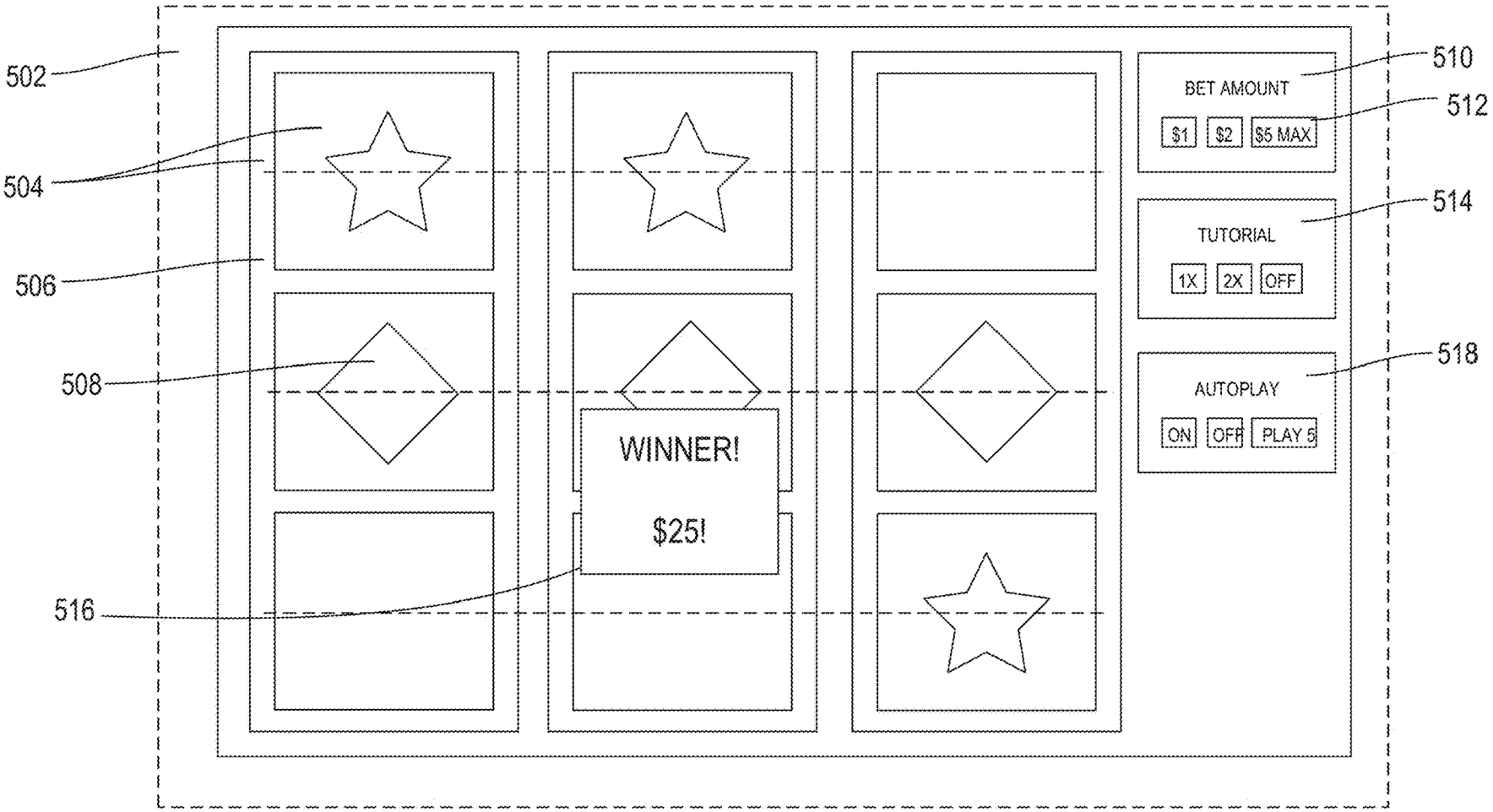
FIG. 5 is a schematic screenshot illustrating using an application according to some embodiments of the inventive concept.

FIG. 5 is a schematic screenshot illustrating using another application according to some embodiments of the inventive concept. In this example, a graphical user interface (GUI) 502 of a gaming device includes a plurality of game elements 504, including a plurality of slot reels 506 and symbols 508, and elements representative of game parameters, such as a bet amount element 510 that can be modified to any number of amounts between a minimum bet amount and a maximum bet amount.

In this example, a player may apply pressure to a pressure sensitive input device, such as the pressure sensitive input device 130 above for example, to modify a current bet amount based on an amount pressure being applied and an amount of time. For example, in response to the first pressure parameter value satisfying a predetermined pressure threshold and the time value satisfying a predetermined time threshold, a current bet amount 512 for a wagering game of the gaming device may be increased to a maximum bet amount. In response to the first pressure parameter value failing to satisfy the predetermined pressure threshold and the time value satisfying the predetermined time threshold, the current bet amount 512 for the wagering game may be reduced by a first predetermined bet increment, e.g., $1 bet increment. In response to the first pressure parameter value satisfying the predetermined pressure threshold and the time value failing to satisfy the predetermined time threshold, the current bet amount 512 may be reduced to a minimum bet amount, e.g., a $1 minimum bet amount. In response to the first pressure parameter value failing to satisfy the predetermined pressure threshold and the time value failing to satisfy the predetermined time threshold, the current bet amount 512 may be increased by a second predetermined bet increment, which may be the same as or different from the first bet increment, as desired.

The player may also, or alternatively, modify an autoplay feature of the gaming device. For example, in response to the first pressure parameter value satisfying a predetermined pressure threshold and the time value satisfying a predetermined time threshold, an autoplay feature 518 of the gaming device may be toggled on or off. In response to the first pressure parameter value failing to satisfy the predetermined pressure threshold and the time value satisfying the predetermined time threshold, the autoplay feature 518 may be activated, so that wagers are placed automatically. In response to the first pressure parameter value satisfying the predetermined pressure threshold and the time value failing to satisfy the predetermined time threshold, the autoplay feature 518 may automatically play a predetermined number of wagering games, or in response to the first pressure parameter value failing to satisfy the predetermined pressure threshold and the time value failing to satisfy the predetermined time threshold, the autoplay feature 518 may automatically play a different predetermined number of wagering games.

The player may also, or alternatively, modify a tutorial feature of the gaming device. For example, in response to the first pressure parameter value satisfying a predetermined pressure threshold and the time value satisfying a predetermined time threshold, a tutorial feature 514 of the gaming device may be deactivated. In response to the first pressure parameter value failing to satisfy the predetermined pressure threshold and the time value satisfying the predetermined time threshold, a presentation speed of the tutorial feature 514 may be increased so that the tutorial is sped up but still available. In response to the first pressure parameter value satisfying the predetermined pressure threshold and the time value failing to satisfy the predetermined time threshold, the tutorial feature 514 may advance to a predetermined subsequent position in the tutorial feature 514, and, in response to the first pressure parameter value failing to satisfy the predetermined pressure threshold and the time value failing to satisfy the predetermined time threshold, the tutorial feature 514 may advance to another preceding or following subsequent position in the tutorial feature 514.

Alternatively, or in addition, a win presentation feature 516 may be controlled by different pressure and time inputs at the gaming device. For example, in response to the first pressure parameter value satisfying a predetermined pressure threshold and the time value satisfying a predetermined time threshold, a win presentation feature 516 may be paused. In response to the first pressure parameter value failing to satisfy the predetermined pressure threshold and the time value satisfying the predetermined time threshold, a current presentation speed of the win presentation feature 516 may be decreased, and, in response to the first pressure parameter value failing to satisfy the predetermined pressure threshold and the time value failing to satisfy the predetermined time threshold, the current presentation speed of the win presentation feature 516 may be increased.

Additional features may also include saving and/or recalling pre-configured game settings based on inputs having different pressures and/or lengths. For example, inputs having different pressures may access different pre-configured bet settings while inputs having different lengths may selectively access, save, and/or overwrite previously accessed settings. In other embodiments, a sequence of inputs having different pressures and/or lengths may provide a sequence of game instructions, with each input modifying a different sequential game interface (e.g., a sequence of low and/or max bets, spinning different reels at different speeds, etc.).

Figure 6:
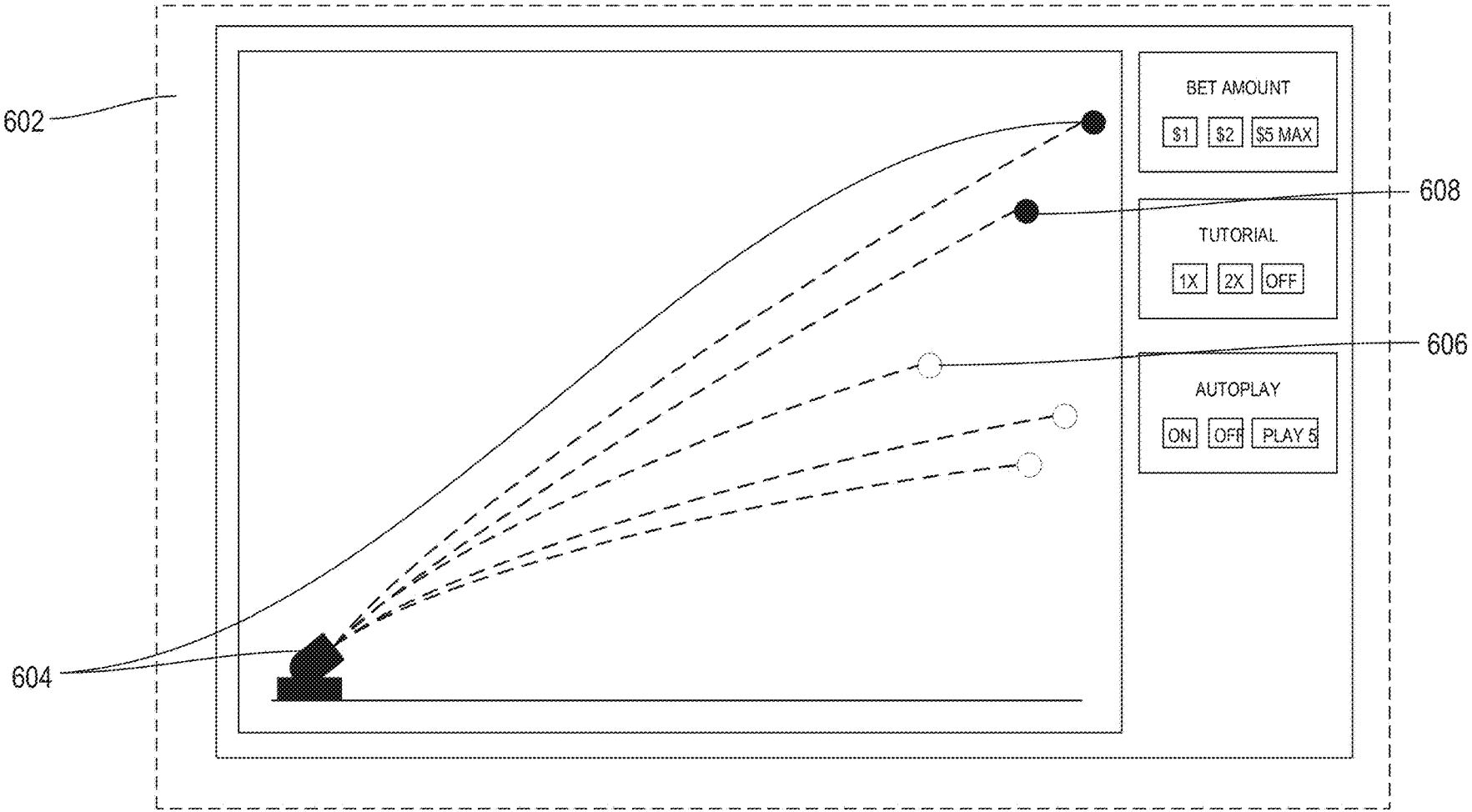
FIG. 6 is a schematic screenshot illustrating using an application according to some embodiments of the inventive concept.

Other features and functionality of the gaming device, such as gameplay elements, may also be controlled using the pressure and time sensitive features described herein. In this regard, FIG. 6 is a schematic screenshot illustrating using another application according to some embodiments of the inventive concept.

In this example, a GUI 602 of the gaming device includes a cannon-shooting game that is controlled by pressure and time sensitive inputs at the gaming device. For example, in response to the first pressure parameter value satisfying a predetermined pressure threshold and the time value satisfying a predetermined time threshold, a graphical game element 604 (e.g., cannon element) of the user interface element fires a series of graphical projectiles of a first type 606 (e.g., artillery shells), and, in response to the first pressure parameter value failing to satisfy the predetermined pressure threshold and the time value satisfying the predetermined time threshold, the graphical game element 604 fires a series of graphical projectiles of a second type 608 (e.g., missiles). In this example, in response to the first pressure parameter value satisfying the predetermined pressure threshold and the time value failing to satisfy the predetermined time threshold, the graphical game element 604 fires a single graphical projectile of the first type 606, and, in response to the first pressure parameter value failing to satisfy the predetermined pressure threshold and the time value failing to satisfy the predetermined time threshold, the graphical game element 604 fires a single graphical projectile of the second type 608.

Figure 7:
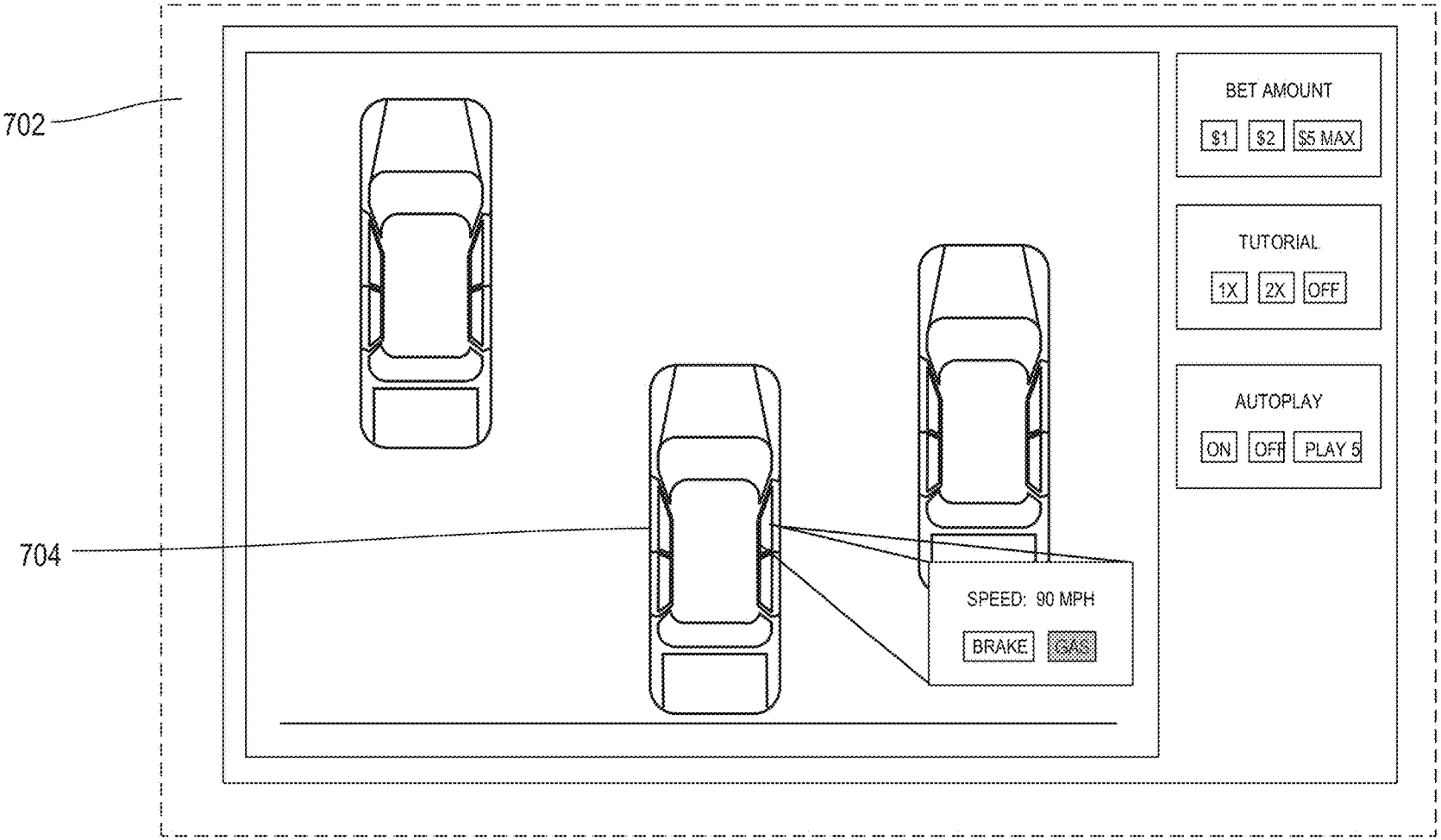
FIG. 7 is a schematic screenshot illustrating using an application according to some embodiments of the inventive concept.

In another example, pressure and time sensitive inputs may be used to simulate driving a car as part of the wagering game at the gaming device. In this regard, FIG. 7 illustrates a GUI 702 for the gaming device in which the player controls a graphical vehicle element 704 (e.g., a car) as part of a racing game. In response to the first pressure parameter value satisfying a predetermined pressure threshold and the time value satisfying a predetermined time threshold, the graphical vehicle element 704 to accelerate at a first acceleration rate for an amount of time, and, in response to the first pressure parameter value failing to satisfy the predetermined pressure threshold and the time value satisfying the predetermined time threshold, the graphical vehicle element 704 accelerates at the first acceleration rate for a different amount of time. In response to the first pressure parameter value satisfying the predetermined pressure threshold and the time value failing to satisfy the predetermined time threshold, the graphical vehicle element 704 to accelerate at a second acceleration rate, and, in response to the first pressure parameter value failing to satisfy the predetermined pressure threshold and the time value failing to satisfy the predetermined time threshold, the graphical vehicle element 704 maintains a current speed.

FURTHER DEFINITIONS AND EMBODIMENTS

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented entirely by hardware, entirely by software (including firmware, resident software, micro-code, etc.) or by combining software and hardware implementation that may all generally be referred to herein as a "circuit," "module," "component," or "system." Furthermore, various embodiments described herein may take the form of a computer program product comprising one or more computer readable media having computer readable program code embodied thereon.

Any combination of one or more computer readable media may be used. The computer readable media may be a computer readable signal medium or a non-transitory computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible non-transitory medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processing circuit of a general purpose computer, special purpose computer, or other programmable data processing apparatus to produce a machine, such that the instructions, which execute via the processing circuit of the computer or other programmable instruction execution apparatus, create a mechanism for implementing the functions/acts specified in the flowchart and/or block diagram block or blocks.

These computer program instructions may also be stored in a non-transitory computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings.

It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A gaming device comprising:

an input device comprising a pressure sensor to detect an amount of pressure applied to the input device by a player of a wagering game at the gaming device;

a processor circuit; and a memory coupled to the processor circuit, the memory comprising machine-readable instructions that, when executed by the processor circuit, cause the processor circuit to:

receive, from the pressure sensor of the input device, a first pressure parameter value corresponding to a first amount of pressure being applied to the input device by the player at a first time;

determine, based on the first pressure parameter value, a time value corresponding to an amount of time that the player has continuously applied pressure to the input device in a first range of pressure amounts, wherein the first amount of pressure is within the first range of pressure amounts; and based on the first pressure parameter value and the time value, modify a user interface element of the gaming device, the modification comprising:

in response to the first pressure parameter value satisfying a predetermined pressure threshold and the time value satisfying a predetermined time threshold, modifying the user interface element to provide a first modified user interface element at the gaming device;

in response to the first pressure parameter value satisfying the predetermined pressure threshold and the time value failing to satisfy the predetermined time threshold, modifying the user interface element to provide a second modified user interface element at the gaming device;

in response to the first pressure parameter value failing to satisfy the predetermined pressure threshold and the time value satisfying the predetermined time threshold, modifying the user interface element to provide a third modified user interface element at the gaming device; and in response to the first pressure parameter value failing to satisfy the predetermined pressure threshold and the time value failing to satisfy the predetermined time threshold, modifying the user interface element to provide a fourth modified user interface element at the gaming device.

2. The gaming device of claim 1, wherein the instructions that cause the processor circuit to determine the time value further cause the processor circuit to:

receive, from the pressure sensor of the input device, a second pressure parameter value corresponding to a second amount of pressure being applied to the input device by the player at a second time, wherein the second amount of pressure is within the first range of pressure amounts, and determine the time value based on the first pressure parameter value, the second pressure parameter value, and a time differential between the first time and the second time corresponding to the amount of time.

3. The gaming device of claim 2, wherein the instructions that cause the processor circuit to determine the time value further cause the processor circuit to:

receive, from the pressure sensor of the input device, a plurality of intermediate pressure parameter values at a plurality of intermediate times between the first time and the second time, wherein each intermediate pressure parameter of the plurality of intermediate pressure parameters corresponds to an intermediate amount of pressure that is within the first range of pressure amounts; and wherein the instructions that cause the processor circuit to modify the user interface element of the gaming device are further based on, for each intermediate pressure parameter, the intermediate amount of pressure being within the first range of pressure amounts.

4. The gaming device of claim 1, wherein:

the first modified user interface element comprises a modification of an audio device volume at a first predetermined rate;

the second modified user interface element comprises a modification of the audio device volume at a second predetermined rate lower than the first predetermined rate;

the third modified user interface element comprises a modification of the user interface element to modify the audio device volume by a first predetermined volume amount; and the fourth modified user interface element comprises a modification of the user interface element to modify the audio device volume by a second predetermined volume amount lower than the first predetermined volume amount.

5. The gaming device of claim 1, wherein:

the first modified user interface element comprises a modification of a current bet amount for a wagering game of the gaming device to a maximum bet amount;

the second modified user interface element comprises a reduction of the current bet amount for the wagering game by a first predetermined bet increment;

the third modified user interface element comprises a modification of a current bet amount for the wagering game to a minimum bet amount; and the first modified user interface element comprises an increase of the current bet amount for the wagering game by a second predetermined bet increment.

6. The gaming device of claim 1, wherein:

the first modified user interface element comprises a toggling of an autoplay feature of the gaming device;

the second modified user interface element comprises an activation of the autoplay feature;

the third modified user interface element comprises automatic play of a first predetermined number of wagering games; and the fourth modified user interface element comprises automatic play of a second predetermined number of wagering games lower than the first predetermined number of wagering games.

7. The gaming device of claim 1, wherein:

the first modified user interface element comprises a deactivation of a tutorial feature of the gaming device;

the second modified user interface element comprises an increase of a presentation speed of the tutorial feature;

the third modified user interface element comprises an advancement to a first subsequent position in the tutorial feature; and the fourth modified user interface element comprises an advancement to a second subsequent position in the tutorial feature that precedes the first subsequent position.

8. The gaming device of claim 1, wherein:

the first modified user interface element comprises a pause of a win presentation feature of the gaming device;

the second modified user interface element comprises a decrease of a current presentation speed of the win presentation feature;

the third modified user interface element comprises a deactivation of the win presentation feature; and the fourth modified user interface element comprises an increase of the current presentation speed of the win presentation feature.

9. The gaming device of claim 1, wherein:

the first modified user interface element comprises a graphical game element of the user interface element firing a series of first graphical projectiles;

the second modified user interface element comprises the graphical game element firing a series of second graphical projectiles;

the third modified user interface element comprises the graphical game element firing a single first graphical projectile; and the fourth modified user interface element comprises the graphical game element firing a single second graphical projectile.

10. The gaming device of claim 1, wherein:

the first modified user interface element comprises a graphical vehicle element in the user interface element accelerating at a first acceleration rate for a first amount of time;

the second modified user interface element comprises the graphical vehicle element accelerating at the first acceleration rate for a second amount of time less than the first amount of time;

the third modified user interface element comprises the graphical vehicle element accelerating at a second acceleration rate lower than the first acceleration rate; and the fourth modified user interface element comprises a modification of the graphical vehicle element maintaining a current speed of the graphical vehicle element.

11. A method comprising:

detecting, by a pressure sensor of an input device of a gaming device, a first amount of pressure being applied by a player to the input device at a first time;

generating, based on detecting the first amount of pressure at the first time, a first pressure parameter value;

receiving, by a processor circuit of the gaming device, the first pressure parameter value from the pressure sensor;

determining, based in part on the first pressure parameter value, a time value corresponding to an amount of time that the player has continuously applied pressure to the input device in a first range of pressure amounts, wherein the first range of pressure amounts comprises the first amount of pressure; and in response to the first pressure parameter value satisfying a predetermined pressure threshold and the time value satisfying a predetermined time threshold, modifying the user interface element to provide a first modified user interface element at a display device of the gaming device;

in response to the first pressure parameter value satisfying the predetermined pressure threshold and the time value failing to satisfy the predetermined time threshold, modifying the user interface element to provide a second modified user interface element at the display device of the gaming device;

in response to the first pressure parameter value failing to satisfy the predetermined pressure threshold and the time value satisfying the predetermined time threshold, modifying the user interface element to display a provide modified user interface element at the display device of the gaming device; and in response to the first pressure parameter value failing to satisfy the predetermined pressure threshold and the time value failing to satisfy the predetermined time threshold, modifying the user interface element to provide a fourth modified user interface element at the display device of the gaming device.

12. The method of claim 11, further comprising:

detecting, by the pressure sensor, a second amount of pressure being applied to the input device at a second time, wherein the second amount of pressure is within the first range of pressure amounts;

generating, based on detecting the second amount of pressure at the second time, a second pressure parameter value;

receiving, by the processor circuit, the second pressure parameter value from the pressure sensor;

determining, by the processor circuit, a time differential between the first time and the second time corresponding to the amount of time that the player has continuously applied pressure to the input device in the first range of pressure amounts; and determining, by the processor circuit, the time value based on the first pressure parameter value, the second pressure parameter value, and the time differential.

13. The method of claim 12, further comprising:

detecting, by the pressure sensor at a plurality of intermediate times between the first time and the second time, a plurality of intermediate amounts of pressure;

generating, based on detecting the plurality of intermediate amounts of pressure at the plurality of intermediate times, a plurality of intermediate pressure parameter values; and receiving, by the processor circuit, the plurality of intermediate pressure parameter values from the pressure sensor, wherein determining the time value is further based on determining, by the processor circuit, that each intermediate amount of pressure is within the first range of pressure amounts.

14. A system comprising:

a processor circuit; and a memory coupled to the processor circuit, the memory comprising machine-readable instructions that, when executed by the processor circuit, cause the processor circuit to:

receive, from a pressure sensor of an input device of a gaming device, a first pressure parameter value corresponding to a first amount of pressure being applied to the input device by a player of the gaming device at a first time;

determine, based on the first pressure parameter value, a time value corresponding to an amount of time that the player has continuously applied pressure to the input device in a first range of pressure amounts, wherein the first amount of pressure is within the first range of pressure amounts;

in response to the first pressure parameter value satisfying a predetermined pressure threshold and the time value satisfying a predetermined time threshold, modifying the user interface element to display a first modified user interface element at a display device of the gaming device;

in response to the first pressure parameter value satisfying the predetermined pressure threshold and the time value failing to satisfy the predetermined time threshold, modifying the user interface element to display a second modified user interface element at the display device of the gaming device;

in response to the first pressure parameter value failing to satisfy the predetermined pressure threshold and the time value satisfying the predetermined time threshold, modifying the user interface element to display a third modified user interface element at the display device of the gaming device; and in response to the first pressure parameter value failing to satisfy the predetermined pressure threshold and the time value failing to satisfy the predetermined time threshold, modifying the user interface element to display a fourth modified user interface element at the display device of the gaming device.

15. The system of claim 14, wherein the instructions that cause the processor circuit to determine the time value further cause the processor circuit to:

receive, from the pressure sensor of the input device, a second pressure parameter value corresponding to a second amount of pressure being applied to the input device by the player at a second time, wherein the second amount of pressure is within the first range of pressure amounts; and determine the time value based on the first pressure parameter value, the second pressure parameter value, and a time differential between the first time and the second time corresponding to the amount of time.

16. The system of claim 15, wherein the instructions that cause the processor circuit to determine the time value further cause the processor circuit to:

receive, from the pressure sensor of the input device, a plurality of intermediate pressure parameter values at a plurality of intermediate times between the first time and the second time, wherein each intermediate pressure parameter of the plurality of intermediate pressure parameters corresponds to an intermediate amount of pressure that is within the first range of pressure amounts; and wherein the instructions that cause the processor circuit to modify the user interface element of the gaming device are further based on, for each intermediate pressure parameter, the intermediate amount of pressure being within the first range of pressure amounts.

* * * * *